United States Patent [19]

Begey et al.

[11] Patent Number: 4,916,835

[45] Date of Patent: Apr. 17, 1990

[54] SPORT SHOE

[75] Inventors: Jean Marie Begey, Bonne; Philippe Billet, Vieux; Claude Perrissoud, Saint-Jorioz, all of France

[73] Assignee: Salomon S.A., Annecy Cedex, France

[21] Appl. No.: 215,157

[22] Filed: Jul. 5, 1988

[30] Foreign Application Priority Data

Jul. 3, 1987 [FR] France ..... 87 9971

[51] Int. Cl.[4] ..... A43B 5/04; A43B 5/00

[52] U.S. Cl. ..... 36/119; 36/58.5; 36/114; 36/120; 128/611

[58] Field of Search ..... 36/117–121, 36/50, 58.5, 114; 128/611

[56] References Cited

U.S. PATENT DOCUMENTS

| | | | |
|---|---|---|---|
| 2,279,951 | 4/1942 | Morein | 128/611 |
| 4,205,467 | 6/1980 | Salomon | 36/119 |
| 4,381,613 | 5/1983 | Lederer | 36/121 |
| 4,580,358 | 4/1986 | Pozzobon | 36/119 |
| 4,601,118 | 7/1986 | Zanatta | 36/120 |
| 4,602,443 | 7/1986 | Spademan | 36/120 |
| 4,624,064 | 11/1986 | Pozzebon | 36/119 |
| 4,694,593 | 9/1987 | Petrini et al. | 36/120 |
| 4,793,076 | 12/1988 | Hilgarth | 36/117 |

FOREIGN PATENT DOCUMENTS

| | | | |
|---|---|---|---|
| 0171384 | 2/1986 | European Pat. Off. . | |
| 891063 | 9/1953 | Fed. Rep. of Germany | 36/119 |
| 3706085 | 9/1987 | Fed. Rep. of Germany | 36/120 |
| 2536966 | 10/1985 | France . | |
| 2545701 | 12/1985 | France . | |

*Primary Examiner*—James Kee Chi

*Attorney, Agent, or Firm*—Pollock, Vande Sande & Priddy

[57] ABSTRACT

The shoe incorporates a shaft (3) jointed (5) to a shell (1) along a transverse axis (5'), connecting two joint pieces (5) on each side of the shoe and connected to one another by a stirrup (6). The joint pieces (5), stationary in relation to the shaft (3), may be moved (52) in an approximately vertical direction in relation to the shell (1) and may be locked into position. The stirrup (6) is located in the upper part of the shell (1) and surrounds the top of the wearer's instep, thereby distributing the bearing stresses exerted by the shaft (3) on the shell (1) in the area of the instep.

15 Claims, 5 Drawing Sheets

FIG: 6
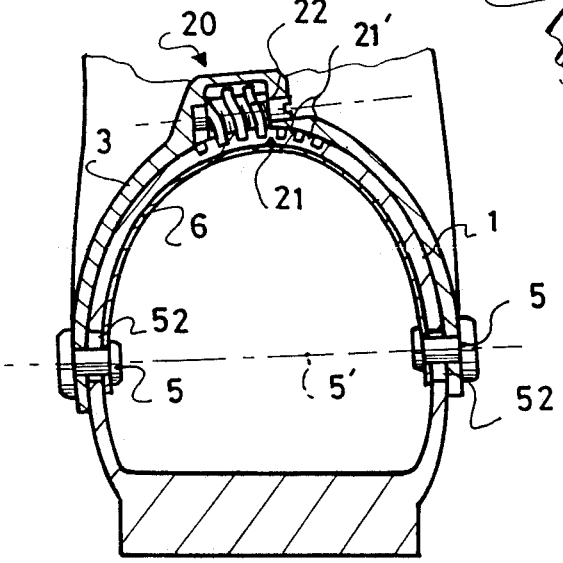
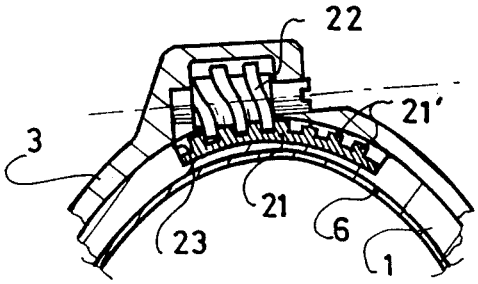
FIG: 6 a
FIG: 7
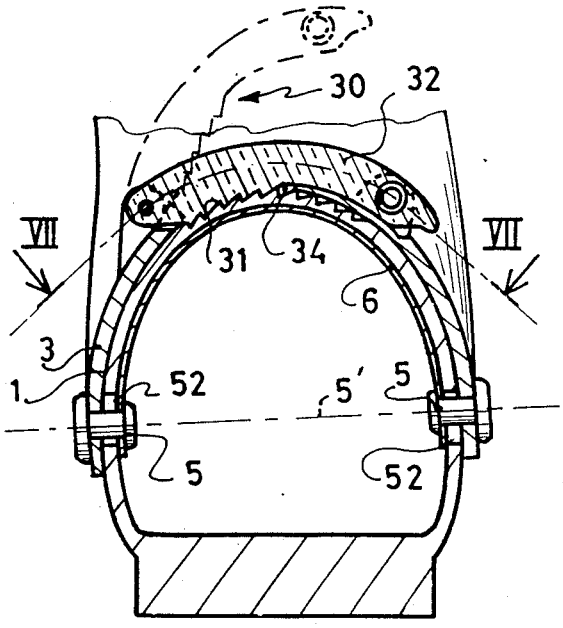
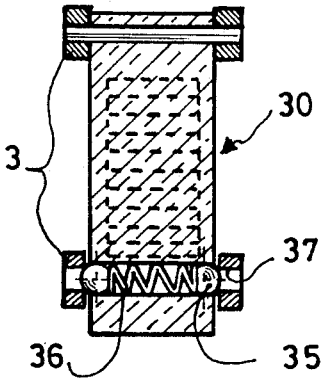
FIG: 7a

SPORT SHOE

FIELD OF THE INVENTION

The present invention concerns shoes incorporating, on the lower portion, a rigid shell comprising one piece with a sole, and on which, on the upper portion, a shaft jointed along a transverse geometric axis joining the two sides of the shell, is mounted.

BACKGROUND OF THE INVENTION

This type of shoe is used, most especially, for skiing, mountaineering, and hiking. In order to adapt the form of the shoe to the anatomical morphology of the foot and ankle, in particular, of each wearer, and in order to ensure that the wearer experiences optimal balance during his activities, mechanisms have already been suggested, which not only allow for variation of the inclination of the shaft in relation to the shell, and thus of the lower leg of the wearer, along the transverse axis, but also permit variation of the inclination of that transverse axis along a geometrical axis, whether or not this axis is given material form by stationary end-pieces, said axis extending longitudinally in relation to the shoe. This is the case, most notably, of the adjustment mechanism described in French Patent Application FR 2 433 311.

According to the description contained in this document, the end-pieces of the transverse axis along which the bottom of the shaft is jointed to the shell, may be moved along a guiding mechanism, in such a way that the transverse axis undergoes rotation around an axis which is longitudinal in relation to the shoe. The end-pieces are then locked in position, thus obtaining the proper adjustment. The two end-pieces of the transverse axis may be moved and locked in place along two slots cut in the opposite sides of the shell.

Two general means for ensuring adjustment and locking into position are proposed in this document. In the first, at least one end-piece of the transverse axis is joined to a notched strip which may be moved and secured in place along a series of notches in a paired profile attached to a small plate joined to the shell in which the slots are cut. In the second, which may be combined with the first, a system comprised of a bolt and nut arranged in parallel fashion to the corresponding slot is used; the bolt is stationary in relation to the portion of the axis, and movable in relation to the shell, relative to which the nut is stationary, or vice-versa.

As for the results obtained, these well-known mechanisms are entirely satisfactory. However, the operation of these mechanisms remains relatively long and delicate. Indeed, to adjust properly the position and inclination of the transverse jointing axis, one end-piece of the axis must be moved upward along the slot, and the other end-piece must be moved downward in the corresponding slot. Thus, two adjustment operations must be performed separately and independently, of one an other. Furthermore, it is often necessary make a rough adjustment of position on each side first, before fine-tuning the adjustment at least on one side, all of which the wearer obviously desires to avoid and sometimes does, in fact, neglect, thus compromising his own comfort.

Attempts have been made to eliminate these disadvantages, by proposing devices for adjusting the inclination of the transverse axis longitudinally, by moving nearly vertically in opposite directions the two ends of the transverse axis using a single operation, and, in addition, by ensuring, nevertheless, that the shaft is optimally secured to the base of the shell, whatever the position of adjustment of this shaft on the base of the shell. All of this would be accomplished by using a single means of operating the adjustment mechanism and holding it in position.

Thus, Patents Nos. FR 2 536 966 and FR 2 545 701, as well as Application EP 0 171 384, describe shoes in which the two ends of the transverse axis, i.e., the points where the shaft is jointed to the shell, are joined by a flexible stirrup-shaped piece surrounding, in a transverse plane, the lower part of the wearer's foot, in the region extending from the plantar support to the malleolus, where the hinges joining the shaft to the shell are found. The mechanisms for operating the adjustment of the stirrup and for holding it in place are installed in the thickness of the sole of the shoe. In Patents Nos. FR 2 536 966 and FR 2 545 701, the stirrup is placed between the exterior wall of the base of the shell and the interior wall of the shaft. In Application No. EP 0 171 384, the stirrup is installed in the interior itself of the shell base of the shoe, with which cooperates with an intermediate guiding piece of the stirrup.

Although these arrangements allow the simultaneous movement of the points at which the shaft is jointed to the shell and which delimit the transverse axis, the skier does not have easy access to them when the shoe is mounted on the ski, because they are placed inside the sole. Furthermore, their lateral force, concentrated between the shaft and the shell, provides adequate support in areas that are very small, and where the stress exerted may reach levels that are far too great, indeed even critical.

SUMMARY OF THE INVENTION

Although retaining the solution consisting of a stirrup joining the ends of the transverse axis, the present invention attempts to avoid the aforementioned problems.

BRIEF DESCRIPTION OF THE DRAWINGS

In order that the invention may be more clearly understood, reference will now be made to the accompanying drawings, in which several embodiments of the invention are shown for purposes of illustration, and in which:

FIGS. 6 and 7 are cross-sections corresponding to plane II—II of FIG. 1, showing other embodiments of devices for adjusting the inclination of the shaft, FIGS. 6*a* and 7*a* showing enlarged details.

DESCRIPTION OF PREFERRED EMBODIMENTS

Figure 1:
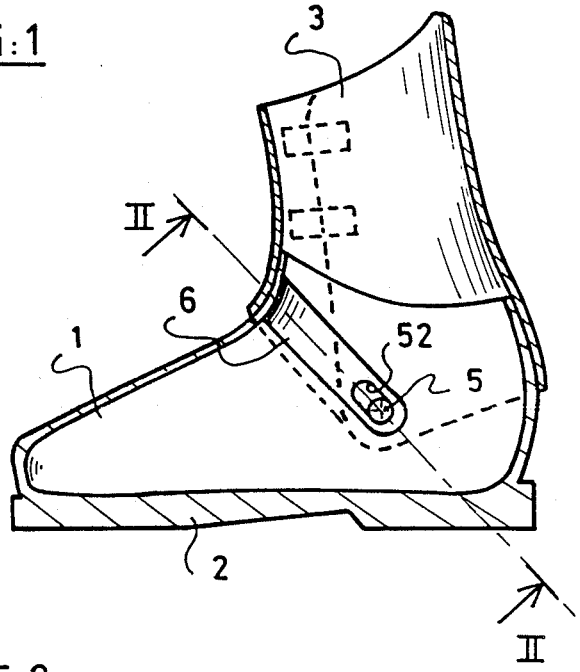
FIG. 1 shows, in longitudinal section (except for the stirrup), a front-entry shoe incorporating the device according to the invention.

The shoe shown in FIGS. 1 to 5 incorporates, in a well-known manner, a rigid shell 1, for example a molded shell, to which is attached a sole 2 and an upper part or shaft 3 made of a single piece opening towards the front and equipped with conventional fastening apparatuses. The shaft 3 is jointed to the shell 1 along a transverse axis 5', connecting two end-pieces 5 that pass through each of the sides of the shell 1 and the shaft 3, and that are stationary as regards translational movement along the axis 5'.

According to the invention, the shoe incorporates a stirrup-shaped piece 6 made of a relatively flexible metal or plastic strip, located in the upper portion of the base of the shell 1 of the shoe and surrounding the upper part of the wearer's instep. The axis end-pieces 5, or hinge pieces joining the shaft 3 to the shell 1, form one piece with the ends of the stirrup 6. In this arrangement, the upper part of the shell base 1, beginning at the jointed pieces 5, is sandwiched between the stirrup 6 and the bottom portion of the shaft 3. In this manner, the force of the support exerted by the base of the shaft 3 on the shell 1 is distributed over this entire area.

Figure 2:
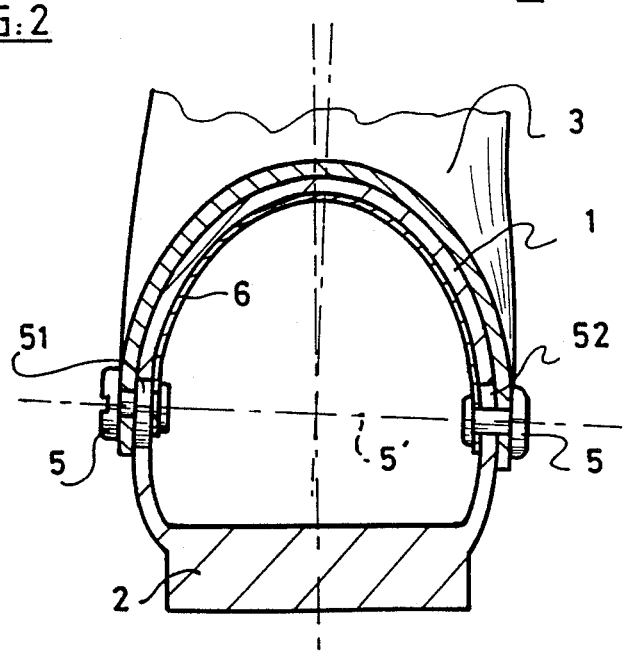
FIG. 2 is a cross-section along the plane II—II in FIG. 1, in which the shoe is tilted toward the right along the transverse axis and the adjustment operation and locking in place are achieved by means of a device incorporating a cam.
Figure 3:
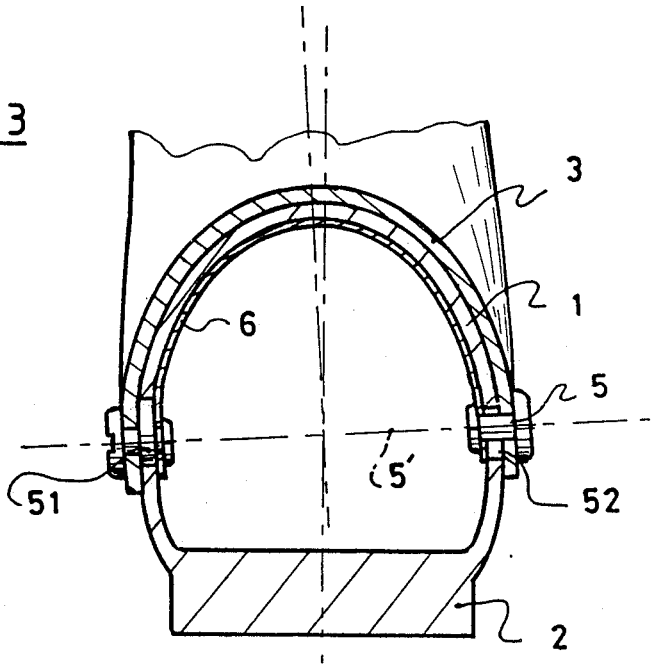
FIG. 3 is similar to FIG. 2, but shows a position of extreme inclination to the left.

In the embodiment illustrated in FIGS. 1 to 3, the jointed pieces 5 attaching the shaft 3 to the shell 3 are comprised, on the one hand (left side of FIGS. 2 and 3), by a mechanism incorporating a cam, which may, be of a conventional type, and, on the other, (as shown on the right side of the same figures), by a conventional joint, whose axis, which is stationary in relation to the shaft 3, may be moved in an approximately vertical slot 52 cut into the shell base. The operation of the cam 51 moves, on its side of the shoe, the joint of shaft 3 in relation to the base of the shell, and this movement is transmitted in the opposite direction by the stirrup 6 to the joint 5 on the opposite side, as the latter is shifted in the slot 52 of the shell base 1. FIGS. 2 and 3 show, respectively, the extreme inclined positions of the axis 5'in either direction and in accordance with the position of the median axis of the shaft 3

Figure 4:
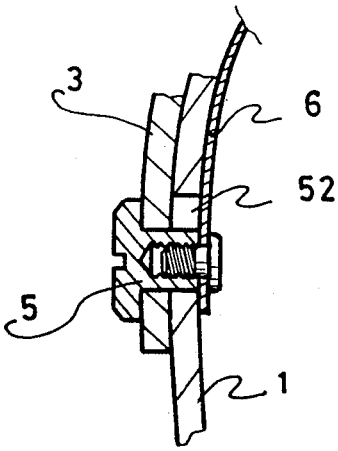
FIG. 4 shows in detail the adjustment-operation and screw-and-nut locking mechanisms.

FIG. 4 illustrates another mechanism for operation of the stirrup 6 according to the invention. This mechanism is of the screw-and-nut type, which is well-known in mechanisms without stirrup or those which have a stirrup crossing the sole; for this reason, further description is unnecessary.

Figure 5:
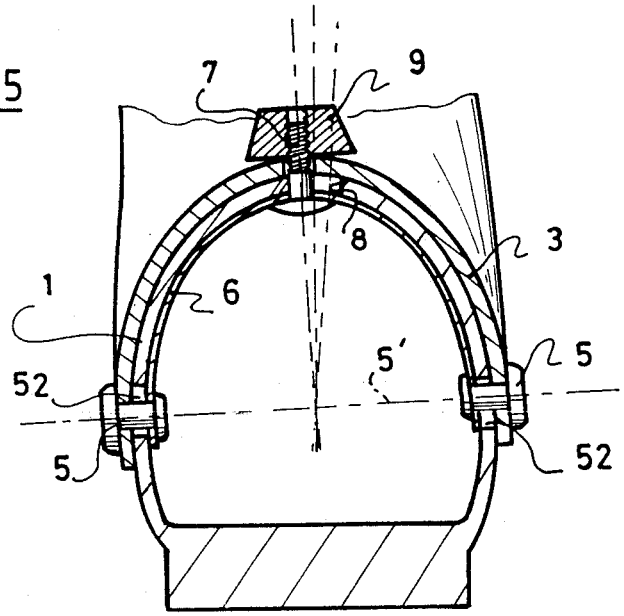
FIG. 5 is a cross-section corresponding to the plane II—II of FIG. 1, showing another adjustment-operation and locking mechanism.
Figure 5A:
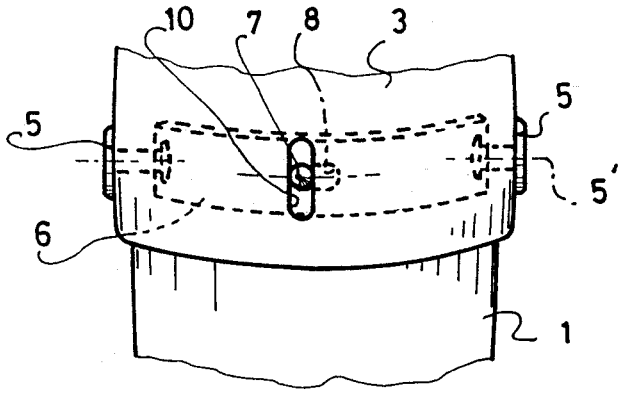
FIG. 5*a* shows in detail the corresponding arrangement of parts on the shaft and the shell of the shoe.

In the embodiment shown in FIG. 5, the rivet-type joints 5, which are fastened to the stirrup 6 and to the shaft 3, are identical, and may be shifted vertically in a slot 52 cut into the shell base 1. In its upper part, the stirrup 6 is fastened to a screw 7 which moves across the shell base 1 in a transverse horizontal slot 8 and across the shaft, in such a way that only axial movement is possible. The screw 7 works in conjunction with a nut 9 resting on the shaft 3 and on the top of the instep. After the nut 9 is loosened, the assembly comprised of the nut 9, the screw 7, the shaft 3, and the stirrup 6 may be swung in either direction in relation to the shell base 1, as the joints 5 and the screw 7 shift in the corresponding slots 52 and 8. When the desired position is obtained, the nut 9 is then tightened to fix that position, by clamping the shell base 1 securely between the stirrup 6 and the shaft 3. In this embodiment of the stirrup-operating mechanism, the screw 7, whose movement is guided in the slot 8 extending transverse to the direction of the bending, prevents the possible flexion, forward and/or backward, of the shaft in relation to the shell base 1. On the other hand, using an operating mechanism of this kind, relative movement of the shaft 3 in relation to the shell base 1 may be provided for; for this purpose (FIG. 5*a*), it is necessary only to cut a slot 10 in the shaft 3 at the spot where the screw 7 passes through, and to orient this slot in the direction of the backward-and-forward movement of the shaft 3.

In the embodiments of the adjustment and operating mechanisms which have just been described with reference to FIGS. 1 to 5, the stirrup 6 is always directly attached to one of the components comprising said mechanisms, such as the cam 51, the screw-nut axis 5, and the screw 7. However, and without going beyond the framework of the invention, the stirrup 6 may also be secured in position in relation to the shell base 1 through the intermediary of the shaft 3, which is, in this case, attached to the stirrup 6 at the level of the axes of the joint pieces 5, while the operating devices may be located at the level of the shaft and the shell base, so as to interact essentially between themselves. FIGS. 6 and 7 show two examples of this type of construction. In FIG. 6, the adjustment mechanism 20 is comprised of an endless screw 22 carried by the shaft 3, which cooperates with positioning devices 21 such as indentations 21 in the form of a toothed rack set in the shell 1. The adjustment mechanism 20 extends transverse to the median longitudinal axis in the shell base in the approximate region of the instep. As was indicated previously, 3 through the intermediary of the joint pieces 5, which may be moved along the slots 52 in the shell base 1.

The adjustment and operating mechanisms 20, just described with reference to FIG. 6, are adapted for use on a shoe in which the means for controlling the forward and/or backward flexion of the shaft 3 in relation to the shell base 1 are located in the upper instep area, between the adjustment mechanism and the portion of the shaft 3 which surrounds the bottom of the skier's leg. However, as shown in FIG. 6, the adjustment mechanism 20 may be adapted to permit the relative movement of the shaft 6 in a forward and/or backward direction in relation to the shell base 1. For this purpose, the positioning mechanism 2 comprising the toothed rack is constituted by a runner guided in translational movement along the shell base 1 in a corresponding slide rail 23.

With reference to FIG. 7, the stirrup 6 is attached to the shaft 3 in the same manner as in FIG. 6. However, in this embodiment, the adjustment mechanism 30 incorporates a notched lever 32 mounted in such a way as to pivot on the shaft 3, as well as a positioning mechanism 31 comprised of a multiplicity of teeth in the shell base 1 which receive the notches of the lever 32. An opening 34 is pierced in the shaft 3 to permit the joint functioning of the notched lever 32 with the teeth 31 carried by the shell base 1. Means for maintaining the lever () in locked position on the shell base 1 are advantageously incorporated at the operating end of the lever. These means are, in this embodiment, constituted by retractable pushers 35 subjected to the action of a spring 36. The pushers cooperate with housings 37 on the shaft 3, in order to maintain the locked position of the lever 32. In this embodiment of the mechanism, the flexion of the shaft 3 in relation to the shell base 1 may easily be provided for; the teeth 31 on the shell base 1 need only be clearly oriented in the direction of the forward-and-backward movement of the shaft 3 and extend for a length which at least surpasses that of the relative movement of the shaft 3 in relation to the shell base. Of course, the teeth 31 may also be placed on a component comprising a runner, which is then guided along the shell base 1 in a corresponding slide rail oriented in the direction of the relative forward and/or backward movement of the shaft 3.

Figure 8:
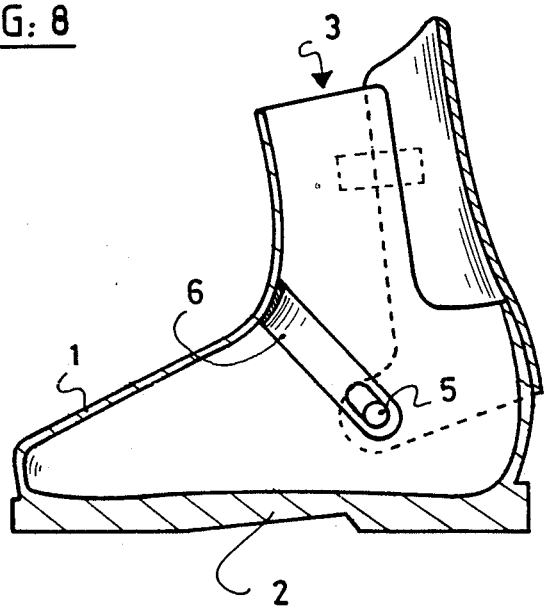
FIG. 8 is similar to FIG. 1, but shows the device according to the invention on a shoe of the rear-entry type.

As may be seen in FIG. 8, which shows a rear-entry type of shoe, everything that has been said concerning a front-entry shoe, such as the shoe in FIG. 1, is completely transposable to a rear-entry shoe.

What is claimed is:

1. A shoe comprising a shaft (3) articulated to a shell base (1) along a transverse axis (5') connecting two end pieces (5) on each side of said shoe, said end pieces being fixed with respect to said shaft (3) but being adjustable in a substantially vertical direction in relation to said shell base (1), said end pieces (5) being connected to one another by stirrup means (6), said means (6) being located inside said shell base (1) in such a way that said shell base (1) is sandwiched between a bottom portion of said shaft and said stirrup means in an area corresponding to an instep of a wearer of said shoe.

2. Shoe according to claim 1, wherein said stirrup means (6) is constituted by a flexible strip.

3. Shoe according to claim 1 or 16, 2 wherein one of said end pieces (5) comprises a cam (51) cooperating with said shell base (1), the other of said end pieces (5) being displaceable along a slot (52) in said shell base (1).

4. Shoe according to claim 1 or 2, wherein said end pieces (5) are of the screw-and-nut type, each of said end pieces being movable along a slot in said shell base (1).

5. Shoe according to claim 1 or 2, wherein said end pieces (5) re of the rivet type, each of said end pieces being movable along a lost (52) in said shell base (1).

6. Shoe according to claim 5, wherein an upper part of said stirrup means (6) is attached to a screw (7) which is movable across said shell base (1) in a transverse slot (8) and said shaft (3), in such a way that only axial play is possible, and which cooperates with an operating nut (9) located outside of said shaft (3).

7. Shoe according to claim 5, wherein an upper part of said stirrup means (6) is attached to a screw (7) which is movable across said shell base 91) in a transverse slot (8), and said shaft (3) may be rotated in another slot (10) substantially perpendicular to said transverse slot (8), said screw cooperating with an operating nut (9) on the outside of said shaft (3).

8. Shoe according to claim 4, wherein at least one of said end pieces (5) of the screw-and-nut type is adapted to be locked into position on said shell base (1) by tightening one of said screw and said nut.

9. Shoe according to claim 1 or 2, wherein said shaft (3) comprises a mechanism (20, 30) for adjustment of the inclination of said transverse axis (5') of said shaft, said adjustment mechanism cooperating with positioning means (21, 31) located on said shell base (1).

10. Shoe according to claim 9, wherein said adjustment mechanism (20) comprises an endless screw (22) having an axis that is transverse in relation to the median longitudinal axis of the shell base, said endless screw cooperating with said positioning means (21), said positioning means consisting of a series of notches constituting a toothed rack engaging said screw (22) supported by said shaft (3).

11. Shoe according to claim 9, wherein said adjustment mechanism (30) comprises a notched lever (32) pivotably mounted by one of its ends on said shaft (3), and a positioning means (31) constituted by notches cut on said shell base (1) and cooperating with said notched lever (32).

12. Shoe according to claim 9, wherein said positioning means (21, 31) are translationally movable on said shell base (1) along guide means (23) oriented in the direction of relative movement of the shaft (3) on said shell base (1).

13. Shoe according to claim 1 or 2, wherein said shoe is of a front-entry type.

14. Shoe according to claim 1 or 2, wherein said shoe is of a rear-entry type.

15. A shoe comprising a shaft (3) articulated to a shell base (1) about a transverse axis (5') connecting two end pieces (5) on each side of said shoe, said end pieces being fixed with respect to said shaft (3) but being adjustable in a substantially vertical direction with respect to said shell base (1), said end pieces being connected by stirrup means (6), and upper portion of said shell base (1) corresponding to an instep of a wearer of said shoe being sandwiched between a lower portion of said shaft (3) and said stirrup means (6) pressed against an inner wall of said upper portion of said shell base.

* * * * *